US005149213A

United States Patent [19]

Yoshida et al.

[11] Patent Number: 5,149,213

[45] Date of Patent: Sep. 22, 1992

[54] NOISE REDUCING BACK STOPPER FOR AN IMPACT PRINT HEAD

[75] Inventors: Hitoshi Yoshida, Kounan; Katsuhiko Yokoi, Nagoya, both of Japan

[73] Assignee: Brother Kogyo Kabushiki Kaisha, Nagoya, Japan

[21] Appl. No.: 692,659

[22] Filed: Apr. 29, 1991

[30] Foreign Application Priority Data

Jul. 11, 1990 [JP] Japan ..... 2-186258

[51] Int. Cl.[5] ..... B41J 2/235; B41J 29/10

[52] U.S. Cl. ..... 400/124; 400/121; 400/689; 310/327; 310/326

[58] Field of Search ..... 310/326, 327, 311; 400/124, 121, 689; 101/93.05

[56] References Cited

U.S. PATENT DOCUMENTS

| | | | |
|---|---|---|---|
| 3,929,124 | 12/1975 | Hebert | 197/1 R |
| 4,214,836 | 7/1980 | Wang | 400/124 |
| 4,396,304 | 8/1983 | Davenport | 400/124 |
| 4,407,591 | 10/1983 | Adamoli | 400/124 |
| 4,502,799 | 3/1985 | Weeks | 400/124 |
| 4,723,854 | 2/1988 | Sakaida | 400/124 |
| 4,781,477 | 11/1988 | Nagasawa | 400/124 |
| 4,895,464 | 1/1990 | Rubinshtein | 400/124 |
| 4,944,615 | 7/1990 | Kato | 400/124 |
| 5,013,169 | 5/1991 | Ikehata | 400/124 |

FOREIGN PATENT DOCUMENTS

| | | | |
|---|---|---|---|
| 92856 | 12/1982 | Japan | 400/689 |
| 212077 | 4/1987 | Japan | 400/689 |
| 62-187733 | 11/1987 | Japan . | |
| 63-63430 | 4/1988 | Japan . | |

OTHER PUBLICATIONS

IBM Tech. Disclosure Bulletin; vol. 32, #9A "Acoustic Noise Reduction . . . " Feb. 1990.

*Primary Examiner*—Edgar S. Burr
*Assistant Examiner*—Eric P. Raciti
*Attorney, Agent, or Firm*—Oliff & Berridge

[57] ABSTRACT

A print head for a dot printer of the present invention includes a plurality of armatures which support a print wire on one end. A back stopper is provided on the rear side of the armatures to stop the armature as the print wire retreats after a print strike. The back stopper is provided with openings so that when an armature strikes the back stopper, upon withdrawal from the print strike, the noise emanated from the back stopper is reduced. A sound dampening piece may be abutted to the rear of the back stopper to further reduce the noise.

13 Claims, 6 Drawing Sheets

NOISE REDUCING BACK STOPPER FOR AN IMPACT PRINT HEAD

BACKGROUND OF THE INVENTION

1. Field of the Invention

The present invention relates to a printer of dot impact type, and more particularly, to a dot printer capable of reducing the noise generated when an armature, which supports a print wire of a print head, retreats and collides with a back stopper.

2. Description of Related Art

In the conventional print head used for this type of printer, the armature supporting the print wire is attracted by an electromagnet which extends the print wire to strike a recording paper through an ink ribbon, thereby adhering ink to the recording paper. After striking the paper, and the end of attraction by the electromagnet, the armature rebounds to a "home" position as a result of the impact of striking the paper reinforced by pressure exerted by a spring. The armature's rebound is ended by colliding with a back stopper for holding the armature in the "home" position. In general, a synthetic resin is used as the material for this back stopper.

As shown, for instance, in Japanese Utility Model Laid-Open Publication No.63-63430 and Japanese Utility Model Laid-Open Publication No. 62-187733, a back stopper having a disk shape is used in the conventional print head.

However, in the print head mentioned above, a great deal of noise is generated when the armature collides with the back stopper while printing. This is because the vibration of the back stopper is easily transmitted to the air by the large surface area of the disk shaped back stopper. The majority of the noise is discharged outside of the device without being absorbed or otherwise attenuated. Therefore, there is a problem in that a pleasant environment for using the print device cannot be obtained.

SUMMARY OF THE PRESENT INVENTION

An object of the present invention is to provide a dot printer with little noise during the printing operation. Another object of the present invention is to provide a dot print head capable of reducing the noise and providing a pleasant environment for using the printer by changing the shape of the back stopper.

According to the present invention, there is provided a print head comprising: an armature which supports a print wire; a back stopper having a slotted shape to the rear side of the armature and by which the end of the armature supporting the print wire is stopped when the print wire is retracted; and a sound absorbing material which is provided adjacent to and in contact with the back stopper on its side away from the armature.

In the print head of the present invention as described above, although the armature touches the back stopper and makes a noise when the armature retreats, the noise generated can be controlled because the back stopper is not solid, rather, it has multiple slots or openings. In addition, the noise that is generated is greatly attenuated by the back stopper's contacting a damper plate of a material for absorbing sound.

As clearly mentioned above, in the present invention, the noise emanated from the back stopper can be controlled because the back stopper contains a plurality of openings for reducing the surface area of the back stopper. Therefore, the dot printer with a print head embodying the present invention does not generate a big noise and provides the user with a noise pleasant environment.

BRIEF DESCRIPTION OF THE DRAWINGS

The invention will be described in association with the drawings in which.

DETAILED DESCRIPTION OF THE PREFERRED EMBODIMENTS

Figure 1:
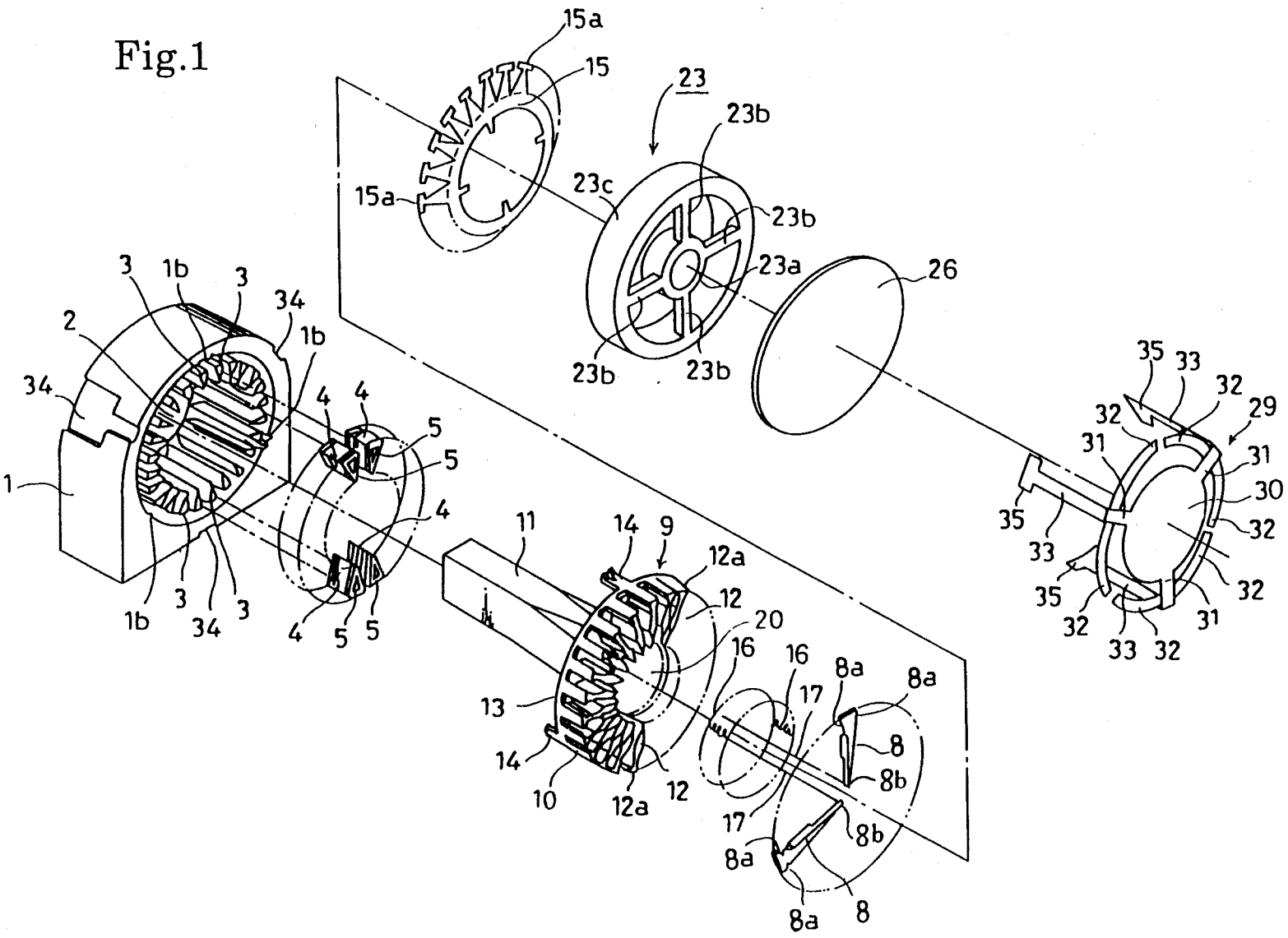
FIG. 1 is an exploded perspective view showing a first embodiment of a print head of a dot printer of the present invention.
Figure 2:
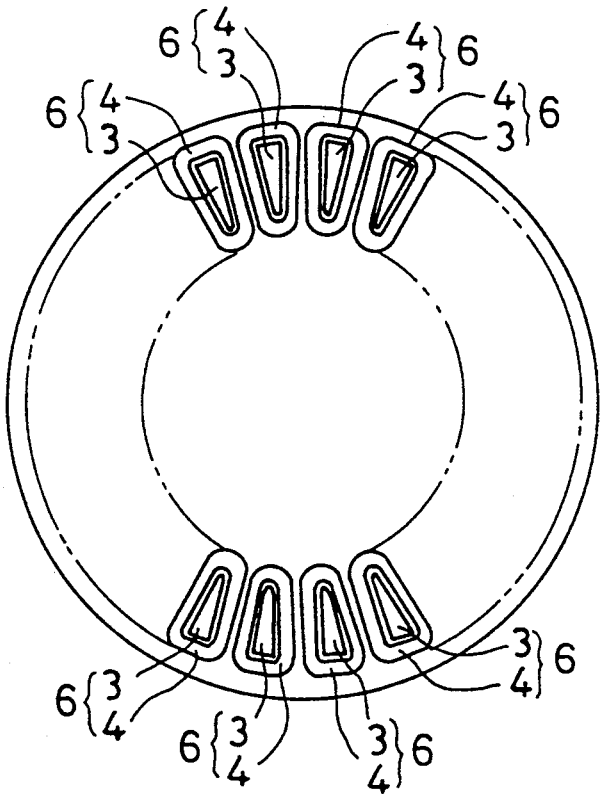
FIG. 2 is a rear elevational view showing the arrangement of electromagnets set in a cylindrical yoke of the first embodiment.

A first embodiment of the present invention will now be described in detail with reference to FIGS. 1–3. As shown in FIGS. 1 and 2, a yoke is a cylindrical ferromagnetic body.

An aperture 2, wherein a guide portion 11 of an armature support frame 9 is inserted, is formed in the center portion of the cylindrical yoke 1. Cores 3 are radially formed along the inner surface of the aperture 2 at predetermined intervals. As shown in FIG. 2, a coil bobbin 5 comprising an exciting coil 4 is installed on each core 3. The combination of each core 3 with the installed coil 4 defines an electromagnet 6.

The armature support frame 9 is arranged behind the cylindrical yoke 1. The armature support frame 9 comprises a support portion 10 and a guide portion 11 which projects from the center of a front side of the support portion 10. A center cylindrical depression 20 having a bottom defined by the attached guide portion is formed in a center of the support portion 10. A plurality of holding plates 12 are radially formed on the rear side of the outer peripheral surface of the support portion 10 for holding an armature 8 in a position corresponding to the position of each electromagnet 6. A holding portion **12*a*, that engages engagement ditches 8*a* formed on the base end of the each armature 8 to prevent the armature 8 from shifting position, is formed on the outer peripheral surface of each holding plate 12. An outer frame 13, which connects the holding plates 12, is formed on the front side, that toward cylindrical yoke 1, of the outer periphery of the support portion 10. A stopper 14, which elastically engages a positioning recess 1*b* in the inner surface of the cylindrical yoke 1 and fixes the position of the armature support frame 9 to the cylindrical yoke 1, is provided on the outer frame 13**.

Each armature 8 is pushed by a suppression portion **15*a* of a suppression spring 15, whose base edge is a belleville spring, and is mounted to the rear side of the outer periphery of the cylindrical yoke 1. Thus, the outer end of each armature 8 is held between a suppression portion 15*a* of the suppression spring 15 and the rear side of the cylindrical yoke 1 such that each armature 8 may pivot back and forth while held in position by holding portions 12***a*. Further, each armature 8 is forced away from the cylindrical yoke 1 by a return spring 16 between the middle portion of the armature 8 and the armature support frame 9. In the tip 8*b* of the each armature 8 is fixed a print wire 17. Each print wire 17 is seated in and guided by a guide passage passing through the guide portion 11 of the armature support frame 9. The guide passages, when viewed from the end of guide portion 11, provide a grid with a guide passage at each intersection of a set number of imaginary parallel, horizontal and vertical lines. Thus, the tips of the print wires 17 are arranged to provide the dot matrix pattern.

A back stopper plate 23, molded from a mixture of a metallic powder material and a synthetic resin material, is arranged behind the armatures 8.

As shown in FIG. 1, an annular contacting portion 23*a* comprises the center portion of the back stopper 23. The diameter of the contacting portion 23*a* is the same as the diameter of a circle passing through points of the armatures 8 between tip 8*b* and engagement ditch 8*a*. The contacting portion 23*a* comes in contact with the armature 8 and stops the retreat of the armature 8 during the printing operation. The contacting portion 23*a* is fixed to an outer frame 23*c* by four supporting bars 23*b* that radiate from the contacting portion 23*a*. The outer frame 23*c* is a ring having the same outer diameter as the armature support frame 9 and presses suppression spring 15 against armature support frame 9 when the print head is assembled. This combination of contacting portion 23*a*, supporting bars 23*b* and outer frame 23*c* have sufficient strength to stop the swing of the armatures 8 and to hold them in a position, yet the shape and the diameter are such that the surface area is minimized. As a result, the surface area of the back stopper of the present invention is smaller than that of the conventional disk type back stopper which results in less vibration or noise.

A damper plate 26 made of metal, plastic or rubber, or a laminate of those materials, is placed to the rear of the back stopper plate 23. The best structure is one having outer layers of metal and a middle layer of a plastic material. The materials are selected based upon their ability to resist heat and abrasion in addition to having a high damping coefficient. The damper plate 26 further reduces the vibration of the back stopper plate 23 caused by stopping the swinging retreat of each armature 8.

A spring frame 29 holds the assembled print head together. The spring frame 29 comprises a disc suppression part 30, a plurality of supporting bars 31 (three supporting bars are shown in FIG. 3) which extend radially from the outer edge of the suppression parts 30 at predetermined spacings based upon their number, an arc shaped suppression portion 32 extending on each side of the supporting bars 31 to press the rear, outer circumference of the damper plate 26, and a support leg 33 which extends from the outer end of each supporting bar 31 toward the cylindrical yoke 1. An engagement bar 35 is formed on the tip of each support leg 33 for engagement with an engagement ditch 34 formed on the outer surface of the cylindrical yoke 1 so that the damper plate 26, the back stopper plate 23, and the armature support frame 9 are held to the cylindrical yoke 1.

In this embodiment, when an exciting voltage is applied to an exciting coil 4 by the print head drive control circuit based on the print data, a magnetic flux is formed between the core 3, mounting the excited exciting coil 4, and the paired armature 8. Thus, the end of armature 8 is attracted by and moves toward the core 3 against the pressure of the return spring 16. As a result, the tip of the print wire 17 mounted at the end of the armature 8 advances to the printing position and the printing operation is executed.

When the excitation of the exciting coil 4 is terminated, the armature 8 is returned to the non-print position by the spring power of the return spring 16 and comes into contact with the contacting portion 23*a* of the back stopper plate 23.

There are two causes for the noise generated by a conventional print head. One is the noise generated by the vibration of the back stopper and the other is from the collision of the armature and the back stopper. The former noise results from the excitation of the air around the back stopper vibrated as a product of the back stopper's vibration caused by the collision of the armature and the back stopper. However, as mentioned above, in the back stopper 23 of this embodiment, the contacting portion 23*a* is small and there is a space between the supporting bars 23*b* so that there is a little surface to vibrate and excite the air. Further, the open collision sound is absorbed in a damper plate 26 and the open space part of the back stopper 23. A part of the energy of the collision sound is changed to thermal energy by the damper plate 26. As the result, the collision sound is greatly decreased by the damper plate and the noise emanating from the print head is reduced.

Figure 3:
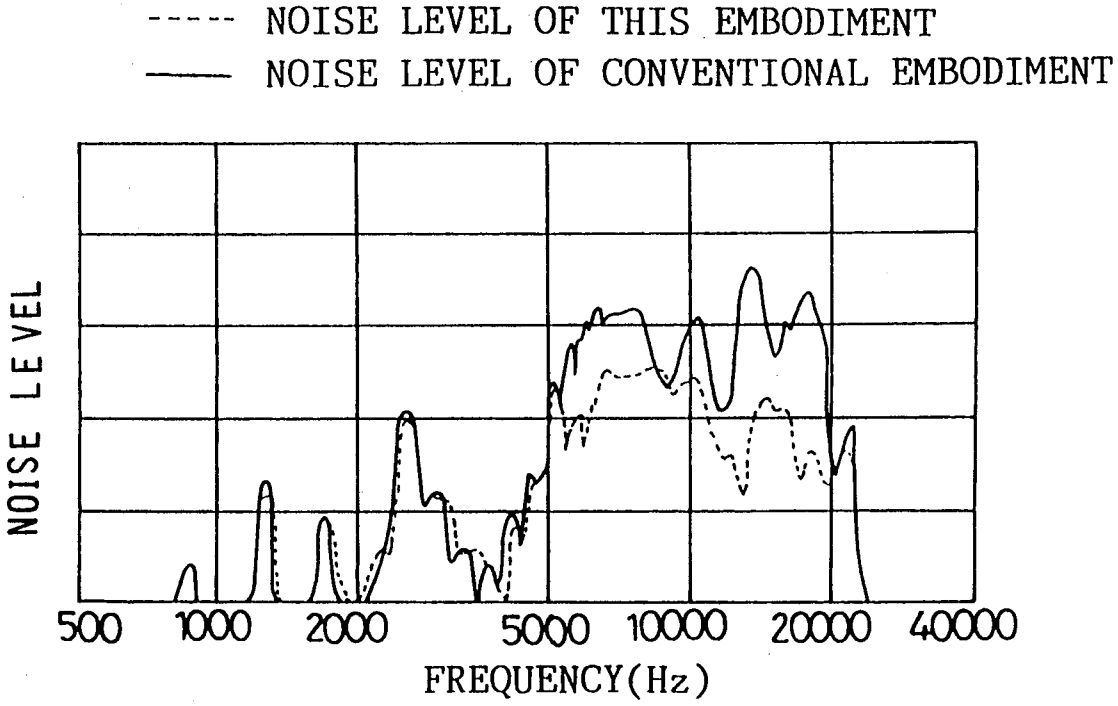
FIG. 3 is a graph showing a frequency spectrum of the noise generated in the first embodiment and a conventional printer.

FIG. 3 shows the spectrum of the noise generated by the printer of the above-mentioned embodiment and the conventional printer using a disk shaped back stopper. However, the portrayed data for the invention is that of a print head without the damper plate 26. As shown in FIG. 3, in the device of this embodiment, even without damper plate 26, it is clearly shown that noise of five kilohertz or more is reduced. This is important as a human's auditory sensitivity at five kilohertz is high and such sounds are recognized as an unpleasant noise.

Therefore, as shown in this embodiment, the amount of noise experienced can be greatly decreased by controlling the noise of a frequency of about five kilohertz.

Further, the damper plate 26 removes the noise in the frequency band under five kilohertz and noise of over five kilohertz is also further decreased by the damper plate 26.

Figure 4A:
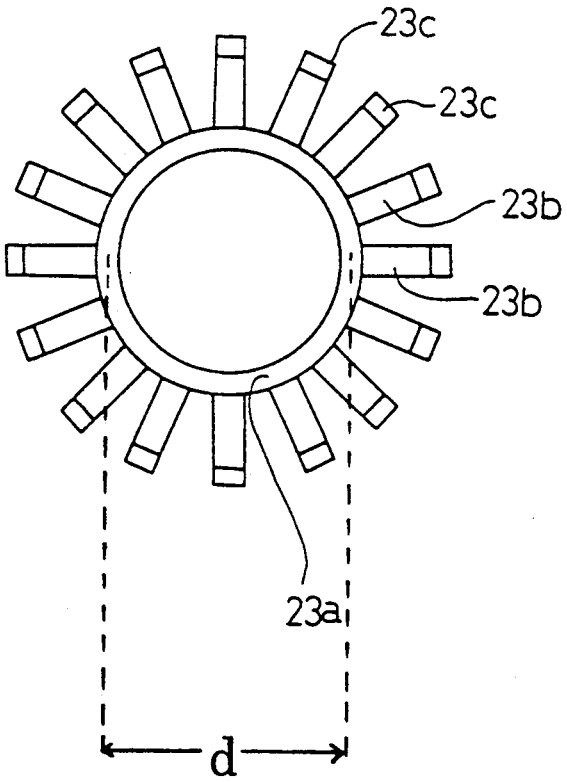
FIG. 4A is a front view showing a variant of the back stopper of a second embodiment.
Figure 4B:
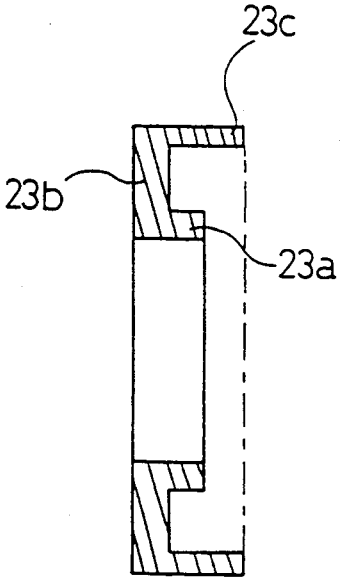
FIG. 4B is a sectional view showing a variant of the back stopper of the second embodiment.

The present invention is not limited to the above-mentioned embodiment. It is possible to raise the strength of the back stopper by increasing the number of the supporting bars. Moreover, in a second embodiment as shown in FIGS. 4A and 4B, it is possible to install a fragment 23*c* on each supporting bar instead of having the annular outer frame.

Next, a third embodiment is explained. In describing the third embodiment, only the shape of the back stopper is explained. The explanation of the other parts is omitted because they are the same as that of the first embodiment.

Figure 5:
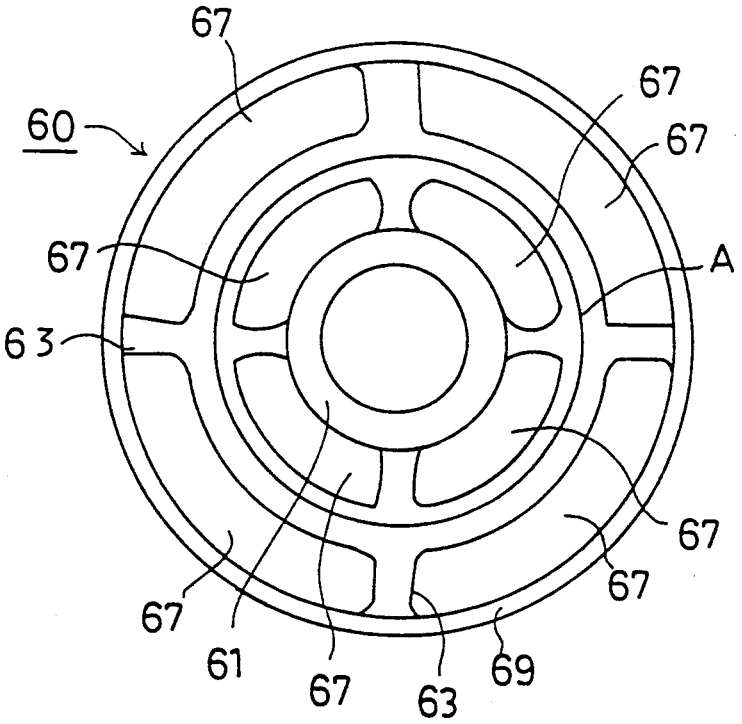
FIG. 5 is a front elevational view showing a back stopper of a third embodiment.

The shape of the back stopper 60 of the third embodiment is shown in FIG. 5. The annular contacting portion 61 of the back stopper 60 has the same diameter as a circle of points on each armature 8 between tip 8*b* and engagement ditch 8*a*. The contacting portion 61 restricts the retreat of the armature 8 after completing the printing strike. A disk shaped supporting plate 63 extends from the annular contacting portion 61 to an outer frame 69. Penetration holes 67 are placed in the supporting plate 63 to reduce the surface area. The outer frame 69 is pressed and fixed against suppression spring 15 by a spring frame (not shown) like spring frame 29 of the first embodiment. In this embodiment, the surface area of the supporting plate 63 is also small compared with a conventional back stopper and the noise can therefore be controlled. Further, the noise reduction is improved by placing the penetration holes 67 at the loops of the standing wave of the back stopper 60, that is on opposite sides of the wave node A that occurs as a result of the strike of a retreating armature against a back stopper.

Figure 6:
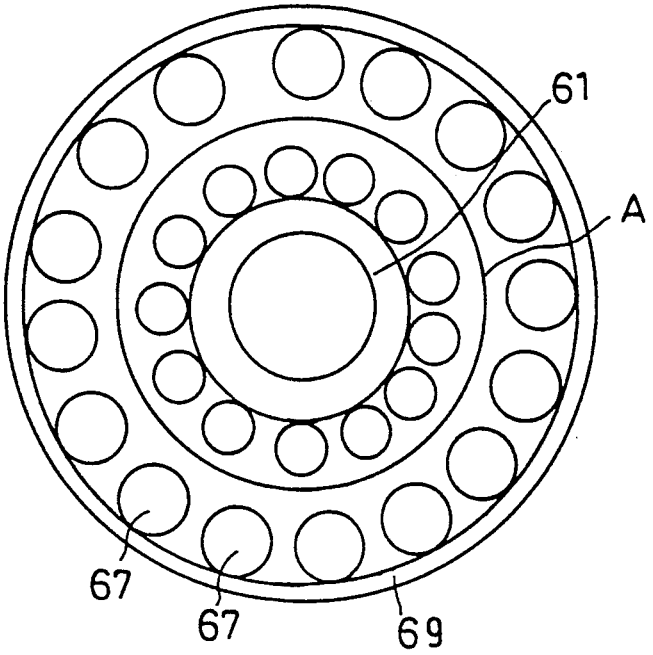
FIGS. 6–8 are front elevational views showing fourth through sixth embodiments of the back stopper.
Figure 7:
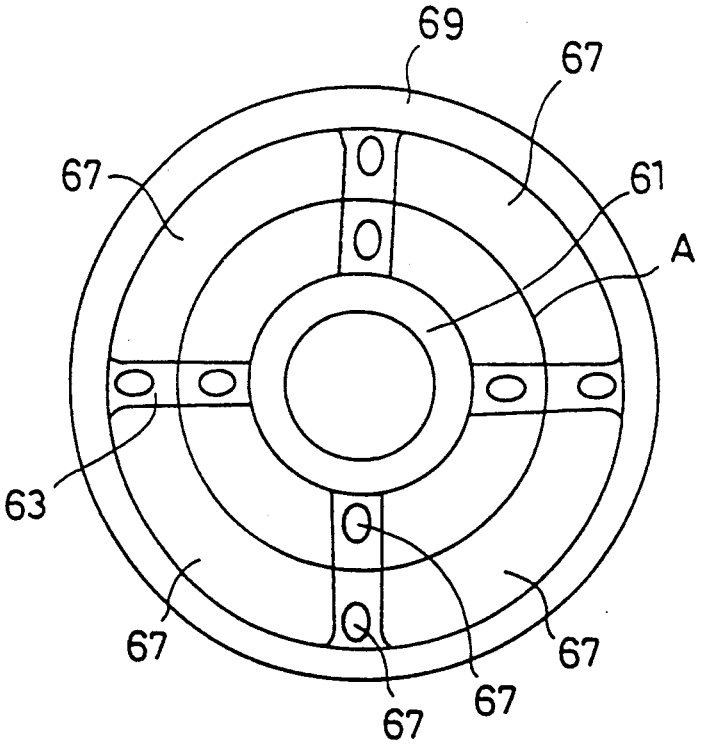
Figure 8:
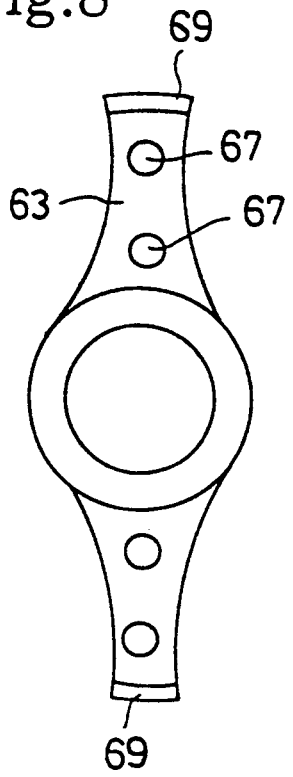

Moreover, the invention is not limited to the back stoppers discussed above. It should be understood that many changes and modifications may be made in the disclosed embodiments without departing from the scope of the invention. For example, in the embodiments shown in FIGS. 6–8, it is possible to adjust the resonance frequency of the back stopper by changing the shape of the penetration holes 67 and to decrease the vibration that produces the unpleasant sound. Moreover, a similar effect may be obtained if notches or other configurations, rather than holes, are used to reduce the surface area.

What is claimed is:

1. A print head for a dot printer comprising:

a yoke for mounting excitation coils;

an armature support frame mounted to said yoke;

a plurality of armatures pivotally mounted in said armature support frame, each said armature supporting a print wire; and a back stopper arranged on a side opposite said print wires of said armatures to stop a retreat of an armature after completing a print strike, said back stopper having integral thereto a contacting portion for contacting the retreating armature, an outer frame for positioning on said armature support frame and a connecting surface between said contacting portion and said outer frame, said connecting surface having a plurality of openings therein.

2. A print head for a dot printer as claimed in claim 1, wherein a noise absorbing material is provided on a side of said back stock stopper opposite to said armature support frame.

3. A print head for a dot printer comprising:

a yoke for mounting excitation coils;

an armature support frame mounted to said yoke, said armature support frame having an outer edge;

a plurality of elongated armatures each having one of two ends pivotally fixed in said outer edge of said armature support frame, the other end of said two ends being swingable and having a print wire mounted therein;

a back stopper having integral thereto a contacting portion contacting a retreating armature on a side opposite said print wire and a plurality of supporting bars extending from said contacting portion toward and engaging said outer edge of said armature support frame, openings between said supporting bars providing a reduced surface area of said back stopper.

4. A back stopper for use with a print head for a dot matrix printer, the print head having a plurality of armatures pivotally mounted to the print head at one end and with a print wire mounted on an opposite swingable end of each armature, the armatures being caused to swing in a forward direction for a print strike and in a backward direction during retreat, the back stopper comprising:

a unitary stopper element having a contacting portion positioned adjacent the swingable end of the armatures for stopping the retreat, a frame positioned adjacent the pivotal end of the armatures, and a support structure connecting said contacting portion and said frame, said support structure having a plurality of openings therein; and a damper plate mounted against a side of said unitary stopper element away from the armatures.

5. A back stopper as claimed in claim 4, wherein the armatures are mounted in a circular array, said contacting portion is an annular rib and said frame is a second annular rib.

6. A back stopper, as claimed in claim 5, wherein said support structure is a plurality of supporting bars and said plurality of openings therein are spacings between said annular ribs.

7. A back stopper as claimed in claim 6, wherein said frame is a discontinuous annular rib embodied as fragments mounted on outer ends of said supporting bars.

8. A print head for a dot printer as claimed in claim 1, wherein said back stopper is molded from a mixture of a metallic powder and a synthetic resin.

9. A print head for a dot printer as claimed in claim 3, wherein said back stopper is molded from a mixture of a metallic powder and a synthetic resin.

10. A back stopper as claimed in claim 4, wherein said stopper element is molded from a mixture of a metallic powder and a synthetic resin.

11. A print head for a dot printer as claimed in claim 2, wherein said noise absorbing material is a damper comprising a three layer laminate, a middle layer of plastic having a metal layer on each side.

12. A print head for a dot printer as claimed in claim 3, further comprising a damper on a back side of said back stopper opposite to said armature support frame, said damper comprising a three layer laminate, a middle layer of plastic having a metal layer on each side.

13. A back stopper as claimed in claim 4, wherein said damper comprises a three layer laminate, a middle layer of plastic having a metal layer on each side.

* * * * *